US006775935B1

(12) United States Patent
Cohen et al.

(10) Patent No.: US 6,775,935 B1
(45) Date of Patent: Aug. 17, 2004

(54) MAGNETIC BULLETIN BOARD

(75) Inventors: Melissa Anne Cohen, Philadelphia, PA (US); Aymen Benaddach Elouadghiri, North Brunswick, NJ (US)

(73) Assignee: Naito, Inc., North Brunswick, NJ (US)

( * ) Notice: Subject to any disclaimer, the term of this patent is extended or adjusted under 35 U.S.C. 154(b) by 0 days.

(21) Appl. No.: 10/283,272

(22) Filed: Oct. 30, 2002

Related U.S. Application Data

(60) Provisional application No. 60/337,902, filed on Nov. 8, 2001.

(51) Int. Cl.[7] ..... G09F 7/00

(52) U.S. Cl. ..... 40/600; 40/661.01; 40/711

(58) Field of Search ..... 40/600, 107, 621, 40/661.01, 711, 124.04; 335/285, 302, 303

(56) References Cited

U.S. PATENT DOCUMENTS 3,456,373 A * 7/1969 Epton ..... 40/124
5,387,999 A * 2/1995 Hayashi ..... 359/557
5,503,891 A * 4/1996 Marshall et al. ..... 428/99
5,987,825 A * 11/1999 Rosen ..... 52/36.1
5,994,990 A * 11/1999 Ogikubo ..... 335/285

* cited by examiner

*Primary Examiner*—Mark T. Le
(74) *Attorney, Agent, or Firm*—C. J. Husar, Esq.

(57) ABSTRACT

A magnetic memo board system simulating in appearance a pushpin memo board comprising a memo board and at least one auxiliary member. The memo board is formed of a magnetizable material having surface ornamentation thereover simulating in appearance a cork material penetratable by the point of a conventional pushpin, the surface ornamentation being substantially transparent to a magnetic fields and having a frame or simulated frame border therearound. The auxiliary member simulates the appearance of a pushpin head when engaged with the memo board and is securely held thereon by a magnet therein.

12 Claims, 1 Drawing Sheet

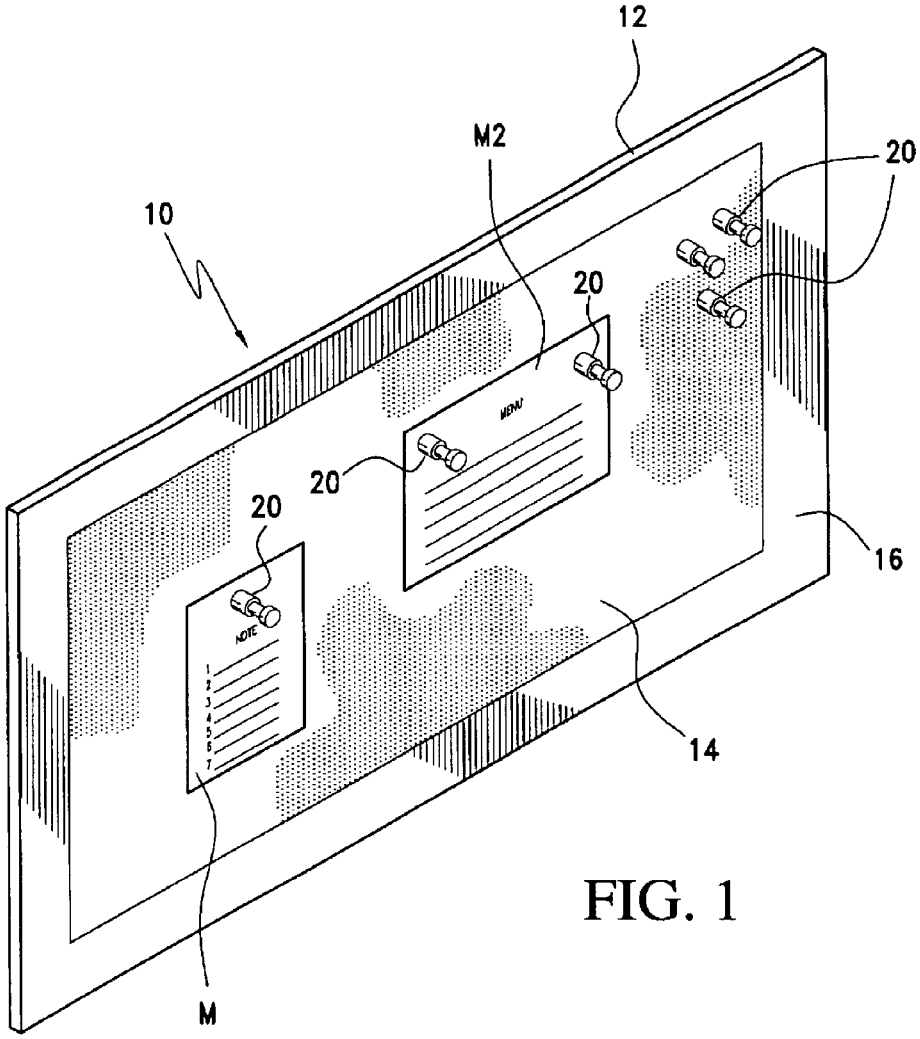
FIG. 1
FIG. 2
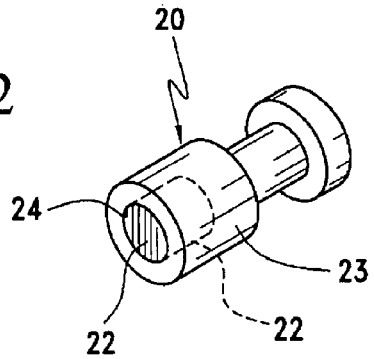

MAGNETIC BULLETIN BOARD

This application claims priority of provisional application Ser. No. 60/337,902 filed Nov. 8, 2001, and titled Magnetic Bulletin Board by Cohen et al.

BACKGROUND OF THE INVENTION

The present invention relates to a magnetic bulletin board and more specifically, it relates to a magnetic bulletin board system wherein the board has a magnetic undersurface, i.e. a surface attracted to a magnet and a cork or cork simulated front surface and a plurality of auxiliary members or memo holders that simulate the appearance of a normal pushpin memo board wherein the memo holders are pushpins.

Pushpin memo boards comprise a framed board surface, usually cork, and a plurality of pushpins and are well known to the public and therefore have the advantage of being self-identifying as to their function and method of use. On the other hand, users of a pushpin have been known to accidentally stab or scratch themselves with the pointed tip of the pushpin. Further, the pushpin represents a serious danger to young children with respect to scratching or jabbing oneself and also the more serious problem of inadvertently swallowing a pushpin and becoming lodged internally within the child's body. Or alternatively, using the pushpin in a manner not intended by the makers of the product such as scratching glass surfaces, wallpapered walls or furniture finish surfaces.

SUMMARY OF THE INVENTION

Applicant's have provided a lightweight magnetic memo board system that includes an undersurface of magnetizable material, such as ferromagnetic material with a simulated cork outer front surface and is used in conjunction with auxiliary members or simulated pushpins that do not have the customary pointed pin projecting therefrom with their attendant disadvantages, namely, scratching oneself, or improper use by young unattended children. Instead, the point of the metallic embedded point of the pushpin has been replaced with an embedded magnet and will readily cling to the simulated cork or other suitable outer simulated surface material due to its attraction to the underlying metallic layer therebeneath. The auxiliary members are provided in the shape of the usual pushpin and also come in a variety of colors to add to the overall appearance of the memo board.

In the preferred embodiment, the surface ornamentation simulates the appearance of cork and includes a border or frame devoid of surface ornamentation. The auxiliary member comprises a simulated pushpin without any projecting pin and includes a flat base surface with a centrally located magnet flush with the base surface of the auxiliary member.

OBJECTS OF THE INVENTION

An object of the invention is to provide a memo board system that retains the appearance of the usual cork, pushpin memo board and yet eliminates its many disadvantages.

Another object of the invention is to provide a memo board system that includes a magnetizable undersurface that will attract an auxiliary member simulating a pushpin.

A further object of the invention is to provide a magnetic memo board system that is pleasing in appearance due to the varied colors of the auxiliary members.

Yet another object of the invention is to provide a magnetic memo board system wherein the auxiliary members are safe to use especially by young children.

A still further object of the invention is to provide an auxiliary member that will not harm a person's foot should it be accidentally stepped on.

A further object of the invention is to provide a light weight aesthetically pleasing memo board system simulating the appearance of a conventional cork, pushpin type bulletin board.

Yet another object of the invention is to provide a memo board that has a photographically projected simulated cork surface thereon with a glossy finish.

These and other objects of the invention will become more apparent hereinafter. The instant invention will now be described with particular reference to the accompanying drawings wherein like reference characters designate the corresponding parts throughout the several views.

BRIEF DESCRIPTION OF THE DRAWINGS

FIG. 1 is a perspective view of a magnetic memo board system according to the invention with a plurality of memo notes thereon.

FIG. 2 is perspective view of the auxiliary member per se.

DETAILED DESCRIPTION OF THE DRAWINGS

Referring now to FIG. 1, there is shown the memo board system generally designated by numeral 10. Also memo board 10 includes a rectangular frame 16 that borders the unit and includes a thin sheet of ferromagnetic material 12. A centrally exposed memo area 14 is disposed within fame 16 and includes surface ornamentation that simulates cork in appearance. A preferred means of applying the surface ornamentation is by a photographic projection process resulting in a simulated cork appearance with a glossy finish. However, frame 16 can be made out of wood, wood composites, plastic or other suitable material. As an alternative, both frame 16 and central memo am 14 may comprise adhesive backed decal type laminates that adhere to the ferromagnetic material 12 to reduce the overall weight of memo board 10. Immediately behind ferromagnetic material 12 is a layer of cardboard to provide support to the ferromagnetic material followed by a thin layer of cork or other suitable backing material. Positioned on central memo area 14 are a plurality of memo notes M, M 2, that are held thereon by the novel auxiliary members 20. Shown in the upper right-hand corner area of memo board 10 are a plurality of auxiliary members 20 for future memo posting. In most instances a single auxiliary member 20 will be sufficient to hold the memo note 20 in place, however, if warranted, a plurality of auxiliary members 20 may be used as shown on memo M 2.

Turning now to FIG. 2, there is shown a single auxiliary member, generally indicated 20. The auxiliary member 20 simulates in appearance the head of a conventional pushpin, i.e. the portion that remains exposed to sight after the pointed end has been inserted into a traditional cork pushpin memo board and are preferably available in a plurality of different colors. As illustrated, a magnet 22 is at least partially embedded within the plastic outer casing 23 of auxiliary member 20 for releasably engaging the magnetizable material 12 of memo board 10 through the outer surface ornamentation 14, which in this case is 8 magnetically transparent material having the simulated appearance of cork material. Preferably, the magnet 22 is a cylindrical magnet, however, it can also be a button magnet of larger diameter than the magnet 22 illustrated. As shown, magnet 22 has only a flat circular surface 22 exposed to view at an open end of casing 23, the remainder of the magnet 22 being concealed within casing 23 of auxiliary member 20. The exposed flat magnetic surface 24 is operative to suspend a memo M. Of course, memo M itself must be formed of material substantially transparent to a magnetic field in order for the memo to be suspended between the auxiliary member 20 (and in particular the face 24 of magnet 22) and the magnetizable material 12 and the surface ornamentation 14 thereon.

As pointed out above, the novel memo board system 10 and auxiliary members 20 are entirely safe to use, from the standpoint of a user puncturing himself, as the auxiliary members 20 as used in conjunction with memo board 10 are devoid of sharp points. Nonetheless, the appearance of the board 10 with one or more auxiliary members 20 thereon is highly suggestive of the traditional cork pushpin board commonly used for suspending memo notes thereon.

While the invention has been described in its preferred embodiment, it is to be understood that the words which have been used are words of description rather than words of limitation and that changes may be made within the purview of the appended claims without departing from the full scope or spirit of the invention. Accordingly, the present invention is t be limited only by the appended claims, and not by the forgoing specification.

Having thus described our invention, We claim:

1. The combination of a magnetic memo board simulating in appearance a pushpin memo board and a plurality of simulated pushpins for holding memos thereon, said magnetic memo board combination comprising:

a memo board formed of magnetizable material having on a major surface thereof surface ornamentation simulating in appearance a cork material penetratable by the point of a pushpin, said surface ornamentation being integral with said magnetzable material and substantially transparent to a magnetic field;

at least one auxiliary member simulating in appearance the head of a pushpin;

each of said at least one auxiliary members simulating pushpins comprising an uppermost first circular portion followed by a second cylindrical portion of reduced diameter and terminating in an enlarged cylindrical portion larger than each of the two previously recited pushpin portions said enlarged cylindrical portion including a magnet therein with said magnet totally encased by said enlarged cylindrical portion except for the bottom surface thereof that is open to expose said magnet therein for releaseably magnetically engaging said memo board to suspend a memo between said auxiliary member and said surface ornamentation whereby said simulated cork memo board and said simulated pushpins cooperate to hold memos therebetween and give the illusion of a real pushpin cork memo board.

2. The combination as defined in claim 1 wherein said surface ornamentation has a glossy surface.

3. The combination as defined in claim 1 wherein said magnet has only a flat surface visible to a viewer with the remainder of the magnet being concealed within said auxiliary member.

4. The combination as defined in claim 1 wherein said surface ornamentation appears non co-extensive with said major surface and leaves a peripheral margin portion of said surface devoid of said surface ornamentation.

5. The combination as defined in claim 1 wherein said peripheral margin simulates a frame for said memo board.

6. The combination as defined in claim 5 wherein said peripheral-margin is a wooden frame.

7. The combination as defined in claim 5 wherein said peripheral margin is a frame made of plastic or other suitable material.

8. The combination as defined in claim 5 wherein said peripheral margin is formed of a decal laminate simulating a wooden frame.

9. The combination as defined in claim 1 wherein a memo formed of a material substantially transparent to a magnetic field is suspended between said auxiliary member magnet and said surface ornamentation.

10. The combination of a magnetic memo board simulating in appearance a pushpin memo board with conventional pushpins comprising:

(a) a memo board of magnetizable material having on a major surface thereof surface ornamentation simulating in appearance a cork material penetratable by the point of a pushpin, said surface ornamentation being integral and substantially transparent to a magnetic field and being non-coextensive with said major surface to leave a peripheral margin portion devoid of said surface ornamentation; and (b) at least one auxiliary member simulating in appearance the head of a pushpin;

each of said simulated pushpins comprising a first circular portion followed by a second cylindrical portion of reduced diameter and terminating in an enlarged cylindrical portion larger than each of the two previously recited pushpin portions;

said enlarged cylindrical portion including magnet therein with said magnet totally encased by said enlarged cylindrical portion except for the bottom surface thereof that is open to expose said magnet therein for releasably magnetically engaging said board to suspend a memo between said auxiliary member and said surface ornamentation, said magnet having only a flat surface exposed to view with the remainder of said magnet means being concealed within said auxiliary member.

11. A magnetic board system as defined in claim 10 further including in combination a memo formed of a material substantially transparent to a magnetic field, said memo being suspended between said auxiliary member magnet and said surface ornamentation.

12. A magnetic board system as defined in claim 10 wherein said magnet means comprises a cylindrical shaped magnet having an axial length greater than its diameter.

* * * * *